US008430017B2

(12) United States Patent
Kurokawa et al.

(10) Patent No.: US 8,430,017 B2
(45) Date of Patent: Apr. 30, 2013

(54) CONTROL DEVICE FOR A HYDRAULIC MOTOR

(75) Inventors: Michio Kurokawa, Kyoto (JP); Hisatoshi Sakurai, Kyoto (JP)

(73) Assignee: Eaton Corporation, Cleveland, OH (US)

( * ) Notice: Subject to any disclaimer, the term of this patent is extended or adjusted under 35 U.S.C. 154(b) by 910 days.

(21) Appl. No.: 12/552,415

(22) Filed: Sep. 2, 2009

(65) Prior Publication Data

US 2011/0048223 A1 Mar. 3, 2011

(51) Int. Cl.
*F15B 11/042* (2006.01)
*F15B 13/04* (2006.01)

(52) U.S. Cl.
USPC ..... 91/491; 91/497

(58) Field of Classification Search ..... 91/418, 91/491, 497, 519; 60/493
See application file for complete search history.

(56) References Cited

U.S. PATENT DOCUMENTS 4,404,896 A * 9/1983 Allart et al. ..... 91/491
RE32,446 E 6/1987 Allart et al.
5,220,790 A 6/1993 Allart et al.

FOREIGN PATENT DOCUMENTS

DE 19715020 A1 * 10/1998
FR 2481755 A1 11/1981
FR 2673684 A1 9/1992

OTHER PUBLICATIONS

International Search Report (Form PCT/ISA/210) for corresponding PCT application.
Written Opinion of the ISA (for PCT/ISA/237) for corresponding PCT application.

* cited by examiner

*Primary Examiner* — Thomas E Lazo
(74) *Attorney, Agent, or Firm* — Quinn Law Group, PLLC

(57) ABSTRACT

A control device for controlling a speed of a hydraulic motor includes a housing defining a first void. A speed valve is disposed within the first void and is moveable between a first speed valve position and a second speed valve position. The first void includes a speed valve pressure chamber disposed at one end of the speed valve. A speed valve spring is disposed at another end of the speed valve. The housing further defines a speed change port and a speed change passage interconnecting the speed change port and the speed change pressure chamber for directing a pressurized fluid directly into the speed valve pressure chamber to exert a pressure force on the speed valve and bias against the speed valve spring to move the speed valve between the first speed valve position and the second speed valve position.

19 Claims, 3 Drawing Sheets

CONTROL DEVICE FOR A HYDRAULIC MOTOR

TECHNICAL FIELD

The subject invention generally relates to hydraulic motors, and more specifically relates to a control device for changing a speed of a hydraulic motor between a first speed and a second speed.

BACKGROUND OF THE INVENTION

Hydraulic motors are mechanical actuators that convert hydraulic pressure and flow into torque, i.e., rotation. Hydraulic motors are utilized in many different applications, such as but not limited too, winches, crane drives, wheel motors for heavy duty equipment such as military vehicles, self driven cranes and excavators, drilling rigs, trench cutters, etc.

The hydraulic motors may operate in a single direction only, or in both a first direction of rotation and an opposite second direction of rotation, i.e., the hydraulic motor may operate in both a forward and reverse direction. Additionally, the hydraulic motors may operate at a first speed or a second speed. The first speed is generally a lower speed producing a higher torque output, while the second speed is generally a higher speed producing a lower torque output.

The hydraulic motors may include a control device to control the speed of the hydraulic motor, i.e., to switch operation of the hydraulic motor between the first speed and the second speed. If the hydraulic motor is configured to operate in both the first direction and the opposite second direction, then the control device must be capable of switching the operating speed of the hydraulic motor when the hydraulic motor is operating in both the first direction and the second direction.

SUMMARY OF THE INVENTION

A control device for a hydraulic motor includes a housing. The housing defines a first void and a plurality of passages. The control device further comprises a speed valve. The speed valve is disposed within the first void. The speed valve includes a spring end and a pressure end spaced from the spring end along a speed valve longitudinal axis. The speed valve is moveable between a first speed valve position and a second speed valve position. The first speed valve position is configured for operating the hydraulic motor at a first speed, and the second speed valve position is configured for operating the hydraulic motor at a second speed. The first void includes a speed valve pressure chamber at least partially defined by the housing and the speed valve. The speed valve pressure chamber is adjacent the pressure end of the speed valve. The housing defines a speed change port and the plurality of passages includes a speed change passage interconnecting the speed change port and the speed valve pressure chamber of the first void. The speed change passage is configured for directing a control fluid directly into the speed valve pressure chamber of the first void from the speed change port to apply a pressure force to the speed valve along the speed valve longitudinal axis to move the speed valve between the first speed valve position and the second speed valve position.

In another embodiment, a hydraulic motor assembly includes a hydraulic motor and a control device coupled to the hydraulic motor. The control device comprises a housing. The housing defines a first void, a second void, a first primary port, a second primary port, and a plurality of passages. The control device further includes a speed valve and a direction valve. The speed valve is disposed within the first void. The speed valve includes a spring end and a pressure end spaced from the spring end along a speed valve longitudinal axis. The speed valve is moveable between a first speed valve position and a second speed valve position. The first speed valve position is configured for operating the hydraulic motor at a first speed, and the second speed valve position is configured for operating the hydraulic motor at a second speed. The direction valve is disposed within the second void. The direction valve is moveable between a first direction valve position and a second direction valve position. The first direction valve position is configured for operating the hydraulic motor in a first direction of rotation, and the second direction valve position is configured for operating the hydraulic motor in a second direction of rotation. The second direction of rotation is opposite the first direction of rotation. The plurality of passages further includes a first feeder passage in fluid communication with the first primary port and the second void, a second feeder passage in fluid communication with the second void and the first void, a third feeder passage in fluid communication with the second primary port and the second void, a fourth feeder passage in fluid communication with the second void and the first void, a fifth feeder passage in fluid communication with the second void and the first void, and a plurality of engine passages in fluid communication with the first void and the hydraulic motor. The plurality of engine passages includes a first engine passage, a second engine passage, a third engine passage and a fourth engine passage. The first void includes a speed valve pressure chamber at least partially defined by the housing and the speed valve. The speed valve pressure chamber is adjacent the pressure end of the speed valve. The housing defines a speed change port. The plurality of passages includes a speed change passage interconnecting the speed change port and the speed valve pressure chamber of the first void. The speed change passage is configured for directing a control fluid directly into the speed valve pressure chamber of the first void from the speed change port to apply a pressure force to the speed valve along the speed valve longitudinal axis to move the speed valve between the first speed valve position and the second speed valve position.

Accordingly, the control device directs the control fluid directly into the speed valve pressure chamber to move the speed valve between the first speed valve position and the second speed valve position. As such, there are no intervening valves or fluid control mechanism required to actuate the speed valve between the first speed valve position and the second speed valve position. The speed valve alters the fluid flow paths within the control device in response to moving between the first speed valve position and the second speed valve position to change the speed of the hydraulic motor between the first speed and the second speed. Additionally, the speed valve only includes the two positions, i.e., the first position and the second position, and controls the speed of the hydraulic motor whether the hydraulic motor is operating in the first direction of operation or the second direction of operation.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Referring to the Figures, wherein like numerals indicate corresponding parts throughout the several views, a control device is shown generally at 20. The control device is coupled to and configured for controlling a hydraulic motor, shown schematically at 22, to form therewith a hydraulic motor assembly, shown generally at 24.

The hydraulic motor 22 receives a working fluid, i.e., a hydraulic fluid, from the control device 20 at a pre-determined high pressure and flow rate, and converts the high pressure and flow of the hydraulic fluid into a torque, i.e., rotational movement of an output shaft (not shown). The pressure of the working fluid is reduced as the hydraulic motor 22 converts the high pressure of the working fluid into the torque. The working fluid flows from the hydraulic motor 22 back through the control device 20 at the reduced pressure.

When the flow rate of the working fluid through the hydraulic motor 22 is constant, increasing the displacement of the hydraulic motor 22 reduces the operating speed of the hydraulic motor 22, but increases the torque generated by the hydraulic motor 22. In contrast, decreasing the displacement of the hydraulic motor 22 increases the operating speed of the hydraulic motor 22, but decreases the torque generated by the hydraulic motor 22.

The hydraulic motor 22 may include, but is not limited to, a tandem motor or a dual displacement motor. The hydraulic motor 22 may include any suitable type of hydraulic motor, such as a gear and vane type hydraulic motor, an axial plunger type hydraulic motor, a radial piston type hydraulic motor, or some other type of hydraulic motor not described herein. The control device disclosed herein is especially well suited for use with a gerotor/geroler type hydraulic motor.

Figure 1:
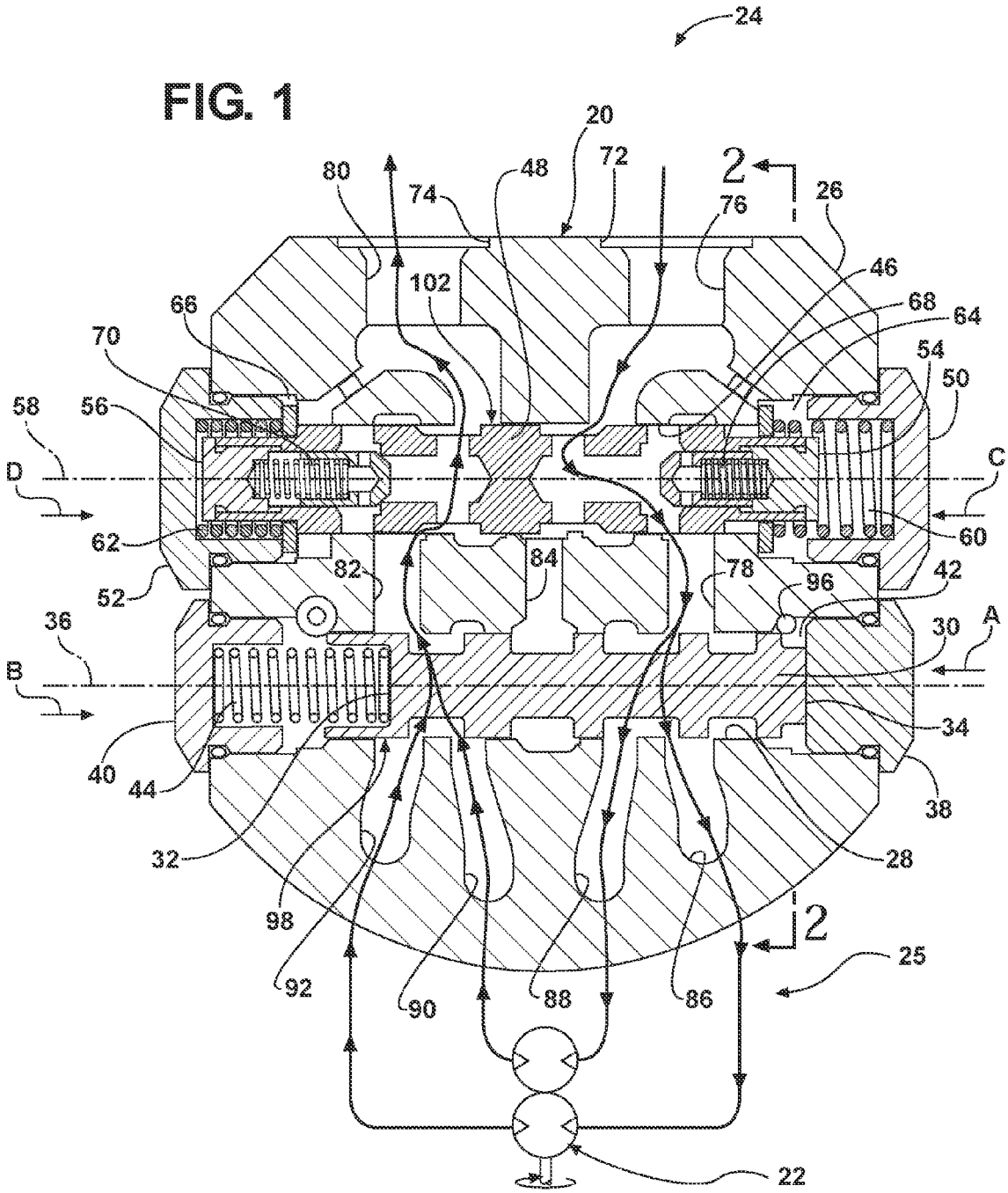
FIG. 1 is a schematic cross sectional view of a control device for a hydraulic motor showing a speed valve of the control device in a first speed valve position for a first speed of the hydraulic motor and a direction valve of the control device in a first direction valve position for a first direction of rotation of the hydraulic motor.
Figure 2:
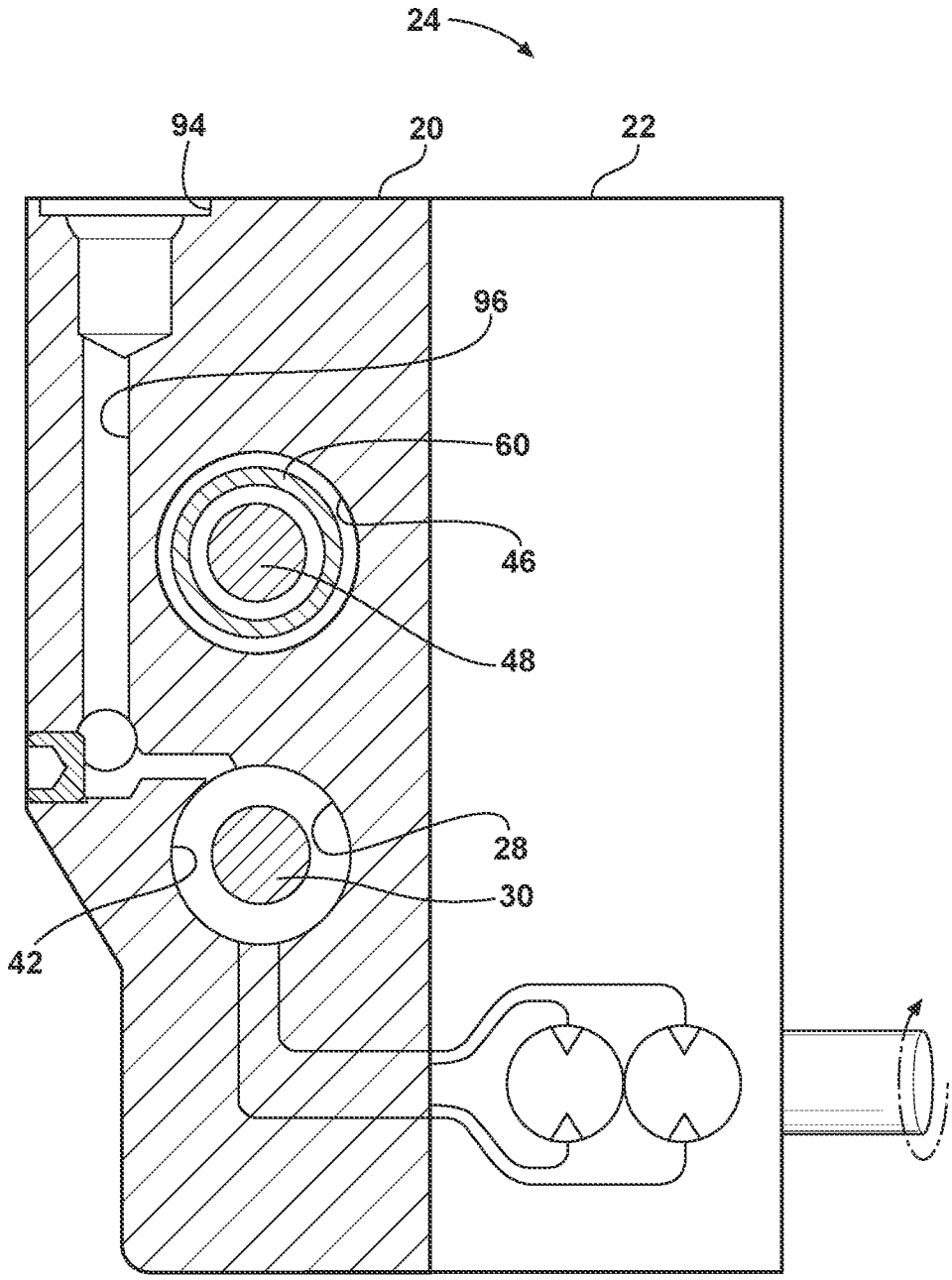
FIG. 2 is a schematic cross sectional view of the control device taken along cutline 2-2 shown in FIG. 1.
Figure 3:
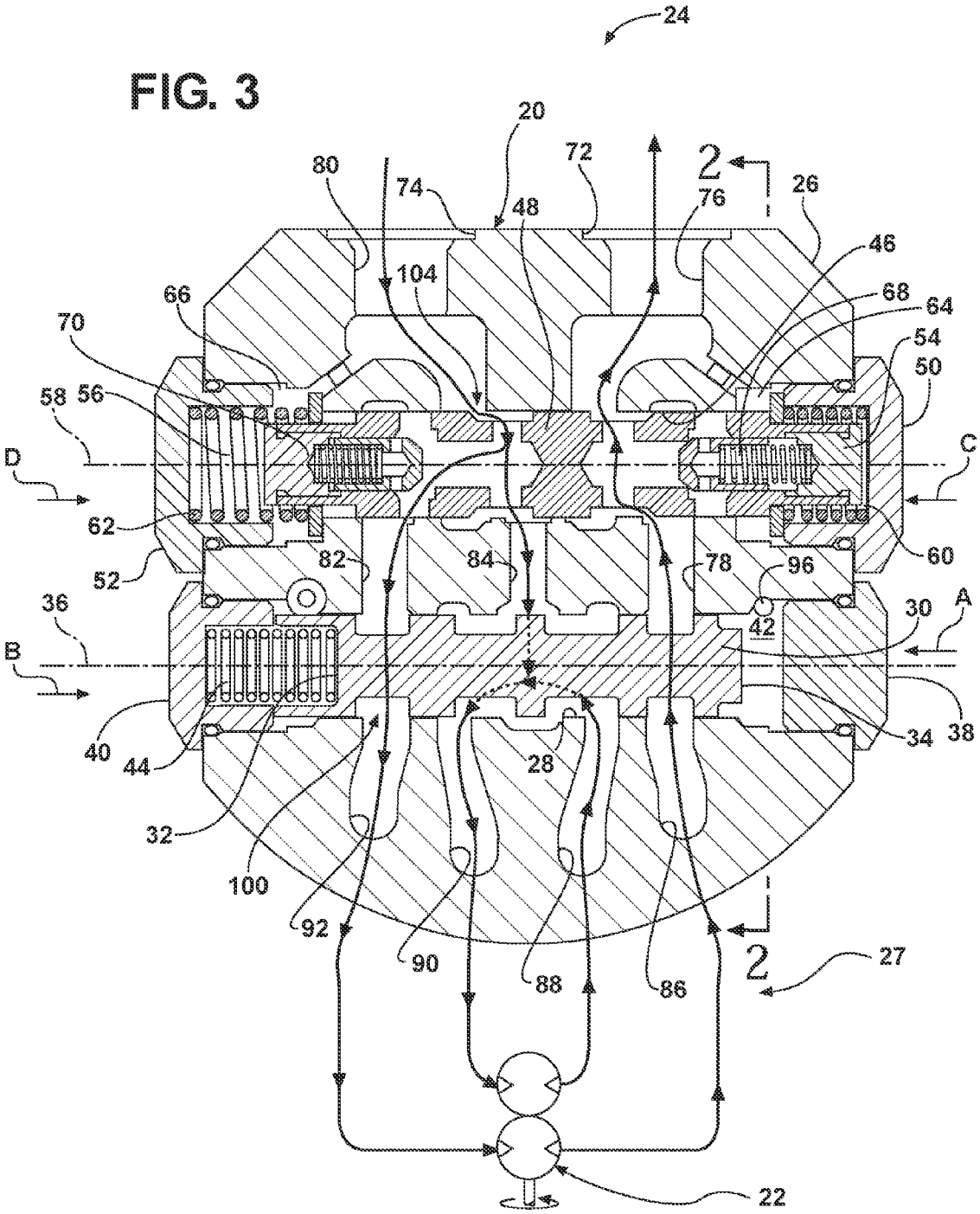
FIG. 3 is a schematic cross sectional view of the control device showing the speed valve in a second speed valve position for a second speed of the hydraulic motor and the direction valve of the control device in a second direction valve position for a second direction of rotation of the hydraulic motor.

The control device 20 controls the supply and return of the working fluid to and from the hydraulic motor 22. As such, the control device 20 provides the working fluid to the hydraulic motor 22 at one of a first flow circuit for a first displacement and a second flow circuit for a second displacement. The first flow circuit is shown schematically at 25 in FIG. 1. The second flow circuit is shown schematically at 27 in FIG. 3. The first flow circuit for a first displacement operates the hydraulic motor 22 at a first speed, and the second flow circuit for as second displacement operates the hydraulic motor 22 at a second speed.

The control device 20 includes a housing 26. The housing 26 is coupled to the hydraulic motor 22. The housing 26 may be directly attached to the hydraulic motor 22, or alternatively may be remote from the hydraulic motor 22 and in fluid communication with the hydraulic motor 22.

The housing 26 defines a first void 28. Preferably, the first void 28 includes a cylindrical shape. However, it should be appreciated that the first void 28 may include some other shape not shown or described herein.

A speed valve 30 is disposed within the first void 28. The speed valve 30 includes a spring end 32 and a pressure end 34. The pressure end 34 is spaced from the spring end 32 along a speed valve longitudinal axis 36. The speed valve 30 is moveable between a first speed valve position 98, shown in FIG. 1, and a second speed valve position 100, shown in FIG. 3. The first speed valve position 98 is configured for operating the hydraulic motor 22 at the first speed, and the second speed valve position 100 is configured for operating the hydraulic motor 22 at the second speed. Accordingly, movement of the speed valve 30 between the first speed valve position 98 and the second speed valve position 100 alters the working fluid's flow paths through the control device 20, to achieve the first fluid flow circuit for the first displacement or the second fluid flow circuit for the second displacement.

The control device 20 may include at least one speed valve cap coupled to and in sealing engagement with the housing 26. The at least one speed valve cap is configured to seal an axial end of the first void 28, and secure the speed valve 30 within the first void 28. As shown in the Figures, the at least one speed valve cap includes a first speed valve cap 38 and a second speed valve cap 40 disposed at opposite ends of the first void 28. However, it should be appreciated that the housing 26 may be manufactured in such a manner to not require one or more of the speed valve caps to seal the first void 28.

The first void 28 includes a speed valve pressure chamber 42. The speed valve pressure chamber 42 is at least partially defined by the housing 26 and the speed valve 30, adjacent the pressure end 34 of the speed valve 30. As shown, one of the speed valve caps also cooperates with the first void 28 and the speed valve 30 to define the speed valve pressure chamber. As will be described below, the speed valve pressure chamber receives a control fluid at a pressure. The pressurized control fluid exerts a pressure force on the speed valve 30 along the speed valve longitudinal axis 36 to urge the speed valve 30 in a first direction indicated at A for moving the speed valve 30 into the second speed valve position 100.

A speed valve spring 44 is disposed within the first void 28, adjacent the spring end 32 of the speed valve 30. As shown, one of the speed valve caps restrains the speed valve spring 44 in place between the speed valve cap and the spring end 32 of the speed valve 30. The speed valve spring 44 is configured for biasing the speed valve 30 along the speed valve longitudinal axis 36 in a second direction indicated at B. The speed valve spring 44 is disposed between and biases against the second speed valve cap 40 and the speed valve 30. The speed valve spring 44 biases against the pressure force applied by the control fluid in the speed valve pressure chamber 42. Accordingly, when the control fluid is introduced into the speed valve pressure chamber 42, the pressure provided by the control fluid acts against the spring force of the speed valve spring 44 to compress the speed valve spring 44 and move the speed valve 30 in the first direction A. In response to a reduced pressure in the control fluid, the speed valve spring 44 overcomes the pressure force applied by the control fluid, and moves the speed valve 30 in the second direction B.

The housing 26 further defines a second void 46. Preferably, the second void 46 includes a cylindrical shape. However, it should be appreciated that the second void 46 may include some other shape not shown or described herein.

The control device 20 may further comprise a direction valve 48. The direction valve 48 may include a counter balance valve function. The direction valve 48 is disposed within the second void 46. The direction valve 48 is moveable between a first direction valve position 102, shown in FIG. 1, and a second direction valve position 104, shown in FIG. 3. The first direction valve position 102 is configured for operating the hydraulic motor 22 in a first direction of rotation, and the second direction valve position 104 is configured for operating the hydraulic motor 22 in a second direction of rotation. The second direction of rotation is opposite the first direction of rotation. The first direction of rotation may include, for example, one of a forward direction and/or a clockwise direction, and the second direction of rotation may include, for example, one of a reverse direction and/or a counter-clockwise direction. The direction valve 48 moves in response to fluid flow through the control device 20. As such, reversing the flow of the working fluid within the control device 20 moves the direction valve 48 between the first direction valve position 102 and the second direction valve position 104.

The control device 20 may include at least one direction valve cap coupled to and in sealing engagement with the housing 26. The at least one direction valve cap is configured for sealing the second void 46 and securing the direction valve 48 within the second void 46. As shown in the Figures, the at least one direction valve cap includes a first direction valve cap 50 and a second direction valve cap 52 disposed at opposite ends of the second void 46. However, it should be appreciated that the housing 26 may be manufactured in such a manner to not require one or more of the direction valve caps to seal the second void 46.

The direction valve 48 includes a first end 54 and a second end 56. The second end 56 of the direction valve 48 is spaced along a direction valve longitudinal axis 58 from the first end 54. A first direction valve spring 60 is disposed within the second void 46 adjacent the first end 54 of the direction valve 48. The first direction valve spring 60 biases the direction valve 48 along the direction valve longitudinal axis 58 in a direction indicated at C. A second direction valve spring 62 is disposed within the second void 46 adjacent the second end 56 of the direction valve 48. The second direction valve spring 62 biases the direction valve 48 against the first direction valve spring 60 along the direction valve longitudinal axis 58 in a direction indicated at D.

As shown, the first direction valve cap 50 restrains the first direction valve spring 60 within the second void 46, with the first direction valve spring 60 disposed between and biasing against the first direction valve cap 50 and the first end 54 of the direction valve 48. The second direction valve cap 52 restrains the second direction valve spring 62 within the second void 46, with the second direction valve spring 62 disposed between and biasing against the second direction valve cap 52 and the second end 56 of the direction valve 48.

The second void 46 includes a first direction valve pressure chamber 64 and a second direction valve pressure chamber 66. The first direction valve pressure chamber 64 is at least partially defined by the second void 46 and the direction valve 48. As shown, the first direction valve cap 50 cooperates with the second void 46 and the direction valve 48 to define the first direction valve pressure chamber 64. The first direction valve pressure chamber 64 is disposed adjacent the first end 54 of the direction valve 48. The second direction valve pressure chamber 66 is at least partially defined by the second void 46 and the direction valve 48. As shown, the second direction valve cap 52 cooperates with the second void 46 and the direction valve 48 to define the second direction valve pressure chamber 66. The second direction valve pressure chamber 66 is disposed adjacent the second end 56 of the direction valve 48.

The direction valve 48 includes a first check valve 68 disposed adjacent the first end 54 of the direction valve 48, and a second check valve 70 disposed adjacent the second end 56 of the direction valve 48. The first check valve 68 and the second check valve 70 operate to open and close fluid passageways within the direction valve 48 as the direction valve 48 moves between the first speed valve position 98 and the second speed valve position 100. When in the first speed valve position 98, the first check valve 68 opens fluid communication between a first portion of the passageways in the direction valve 48, and the second check valve 70 closes fluid communication between a second portion of the passageways in the direction valve 48. When in the second speed valve position 100, the first check valve 68 closes fluid communication between the first portion of the passageways in the direction valve 48, and the second check valve 70 opens fluid communication between the second portion of the passageways in the direction valve 48.

The housing 26 further defines a first primary port 72 and a second primary port 74. When the hydraulic motor 22 operates in the first direction of rotation, the working fluid flows into the control device 20 into the first primary port 72, and exits the control device 20 after circulating through the hydraulic motor 22 through the second primary port 74. When the hydraulic motor 22 operates in the second direction of rotation, the working fluid flows into the control device 20 into the second primary port 74, and exits the control device 20 after circulating through the hydraulic motor 22 through the first primary port 72.

The first direction valve pressure chamber 64 is in fluid communication with the first feeder passage 76 via fluid passage, and is configured to receive the working fluid therefrom to provide a pressure force against the direction valve 48 along the direction valve longitudinal axis 58 to move the direction valve 48 between the first direction valve position 102 and the second direction valve position 104. The second direction valve pressure chamber 66 is in fluid communication with the third feeder passage 80 via another fluid passage, and is configured to receive the working fluid therefrom to provide a pressure force against the direction valve 48 along the direction valve longitudinal axis 58 to move the direction valve 48 between the first direction valve position 102 and the second direction valve position 104. Accordingly, if the pressurized working fluid enters the control device 20 through the first primary port 72, the working fluid at the high pressure flows into the first direction valve pressure chamber 64 and exerts a force on the direction valve 48 to move the direction valve 48 in the direction indicated at C into the first direction valve position 102. In contrast, if the pressurized working fluid enters the control device 20 through the second primary port 74, the working fluid at the high pressure flows into the second direction valve pressure chamber 66 and exerts a force on the direction valve 48 to move the direction valve 48 in the direction indicated at D into the second direction valve position 104.

The housing 26 further defines a plurality of passages. The plurality of passages includes a first feeder passage 76, a second feeder passage 78, a third feeder passage 80, a fourth feeder passage 82, a fifth feeder passage 84, and a plurality of engine passages. The first feeder passage 76 is in fluid communication with the first primary port 72 and the second void 46. The second feeder passage 78 is in fluid communication with the second void 46 and the first void 28. The third feeder passage 80 is in fluid communication with the second primary port 74 and the second void 46. The fourth feeder passage 82 is in fluid communication with the second void 46 and the first void 28. The fifth feeder passage 84 is in fluid communication with the second void 46 and the first void 28. The plurality of engine passages are in fluid communication with the first void 28, and are configured for and are in fluid communication with the hydraulic motor 22. The plurality of engine passages includes a first engine passage 86, a second engine passage 88, a third engine passage 90 and a fourth engine passage 92.

The housing 26 defines a speed change port 94, and the plurality of passages further includes a speed change passage 96. The speed change passage 96 interconnects the speed change port 94 and the speed valve pressure chamber 42 of the first void 28. The speed change passage 96 is configured for directing the control fluid directly into the speed valve pressure chamber 42 of the first void 28 from the speed change port 94. Accordingly, it should be appreciated that the control fluid does not operate to open a valve to allow the working fluid into the speed valve pressure chamber 42, but rather the control fluid flows directly into the speed valve pressure chamber 42 to act upon the speed valve 30 directly. The control fluid is another form of a hydraulic fluid, and may include, but not necessarily include, the same hydraulic fluid utilized as the working fluid. As described above, the control fluid is at a pre-determined pressure and applies a pressure force to the speed valve 30 along the speed valve longitudinal axis 36. The pressure force acts against the speed valve spring 44 to move the speed valve 30 between the first speed valve position 98 and the second speed valve position 100. When the pressure force is greater than the spring force of the speed valve spring 44, the pressure force urges the speed valve 30 in the direction A into the second speed valve position 100. When the spring force of the speed valve spring 44 is greater than the pressure force applied by the control fluid, the speed valve spring 44 moves the speed valve 30 in the direction B into the first speed valve position 98.

When the speed valve 30 is in the first speed valve position 98, two of the plurality of engine passages are configured to direct the working fluid to the hydraulic motor 22, and another two of the plurality of engine passages are configured to receive the working fluid from the hydraulic motor 22. Which two of the engine passages directs the working fluid to the hydraulic motor 22 and which two of the engine passages receives the working fluid from the hydraulic motor 22 after circulating through the hydraulic motor 22 is dependent upon which direction of rotation the hydraulic motor 22 is operating in. When the hydraulic motor 22 is operating in the first direction of rotation, the first engine passage 86 and the second engine passage 88 direct the working fluid to the hydraulic motor 22 and the third engine passage 90 and the fourth engine passage 92 receive the working fluid from the hydraulic motor 22. When the hydraulic motor 22 is operating in the second direction of rotation, the fourth engine passage 92 and the third engine passage 90 direct the working fluid to the hydraulic motor 22 and the second engine passage 88 and the first engine passage 86 receive the working fluid from the hydraulic motor 22.

The control device 20 includes the following fluid flow paths when the speed valve 30 is positioned in the first position and the direction valve 48 is in either of the first direction valve position 102 and the second direction valve position 104, for operating the hydraulic motor 22 at the first speed in either one of the first direction of rotation and the second direction of rotation. The fluid flow paths include the first feeder passage 76 being in fluid communication with the second feeder passage 78, the second feeder passage 78 being in fluid communication with the first engine passage 86 and the second engine passage 88, the third feeder passage 80 being in fluid communication with the fourth feeder passage 82, and the fourth feeder passage 82 being in fluid communication with the third engine passage 90 and the fourth engine passage 92.

When the speed valve 30 is in the second speed valve position 100, three of the plurality of engine passages are configured to direct a working fluid to the hydraulic motor 22 and another one of the plurality of engine passages is configured to receive the working fluid from the hydraulic motor 22. Which of the engine passages directs the working fluid to the hydraulic motor 22 and which one of the engine passages receiving the working fluid from the hydraulic motor 22 after circulating through the hydraulic motor 22 is dependent upon which direction of rotation the hydraulic motor 22 is operating in. When the hydraulic motor 22 is operating in the first direction of rotation, the first engine passage 86, the second engine passage 88 and the third engine passage 90 direct the working fluid to the hydraulic motor 22 and the fourth engine passage 92 receives the working fluid from the hydraulic motor 22. When the hydraulic motor 22 is operating in the second direction of rotation, the fourth engine passage 92, the third engine passage 90 and the second engine passage 88 direct the working fluid to the hydraulic motor 22, and the first engine passage 86 receives the working fluid from the hydraulic motor 22.

The control device 20 includes the following fluid flow paths when the speed valve 30 is positioned in the second position and the direction valve 48 is positioned in the first direction valve position 102, for operating the hydraulic motor 22 at the second speed in the first direction of rotation. The fluid flow paths include the first feeder passage 76 being in fluid communication with the second feeder passage 78 and the fifth feeder passage 84, the second feeder passage 78 being in fluid communication with the first engine passage 86, the fifth feeder passage 84 being in fluid communication with the second engine passage 88 and the third engine passage 90, the fourth engine passage 92 being in fluid communication with the fourth feeder passage 82, and the fourth feeder passage 82 being in fluid communication with the third feeder passage 80.

The control device 20 includes the following flow fluid flow paths when the speed valve 30 is positioned in the second position and the direction valve 48 is positioned in the second direction valve position 104, for operating the hydraulic motor 22 at the second speed in the second direction of rotation. The fluid flow paths include the third feeder passage 80 being in fluid communication with the fourth feeder passage 82 and the fifth feeder passage 84, the fourth feeder passage 82 being in fluid communication with the fourth engine passage 92, the fifth feeder passage 84 being in fluid communication with the third engine passage 90 and the second engine passage 88, the first engine passage 86 being in fluid communication with the second feeder passage 78, and the second feeder passage 78 being in fluid communication with the first feeder passage 76.

While the best modes for carrying out the invention have been described in detail, those familiar with the art to which this invention relates will recognize various alternative designs and embodiments for practicing the invention within the scope of the appended claims.

The invention claimed is:

1. A control device for a hydraulic motor, the control device comprising:

a housing defining a first void, a second void, and a plurality of passages;

a speed valve disposed within said first void and including a spring end and a pressure end spaced from said spring end along a speed valve longitudinal axis, wherein said speed valve is moveable between a first speed valve position and a second speed valve position, with said first speed valve position configured for operating the hydraulic motor at a first speed and said second speed valve position configured for operating the hydraulic motor at a second speed;

wherein said first void includes a speed valve pressure chamber at least partially defined by said housing and said speed valve adjacent said pressure end of said speed valve;

wherein said housing defines a speed change port and said plurality of passages includes a speed change passage interconnecting said speed change port and said speed valve pressure chamber of said first void, with said speed change passage configured for directing a control fluid directly into said speed valve pressure chamber of said first void from said speed change port to apply a pressure force to said speed valve along said speed valve longitudinal axis to move said speed valve between said first speed valve position and said second speed valve position; and a direction valve disposed within said second void and moveable between a first direction valve position and a second direction valve position, with said first direction valve position configured for operating hydraulic motor in a first direction of rotation and said second direction valve position configured for operating the hydraulic motor in a second direction of rotation opposite the first direction of rotation;

wherein said speed valve is operable to change between said first speed valve position and said second speed valve position when said direction valve is disposed in either said first direction valve position or said second direction valve position.

2. A device as set forth in claim 1 wherein said housing defines a first primary port and a second primary port and said plurality of passages further includes a first feeder passage in fluid communication with said first primary port and said second void, a second feeder passage in fluid communication with said second void and said first void, a third feeder passage in fluid communication with said second primary port and said second void, a fourth feeder passage in fluid communication with said second void and said first void, a fifth feeder passage in fluid communication with said second void and said first void, and a plurality of engine passages in fluid communication with said first void and configured for fluid communication with the hydraulic motor.

3. A device as set forth in claim 2 wherein said plurality of engine passages includes a first engine passage, a second engine passage, a third engine passage and a fourth engine passage.

4. A device as set forth in claim 3 wherein two of said plurality of engine passages are configured to direct a working fluid to the hydraulic motor and another two of said plurality of engine passages are configured to receive the working fluid from the hydraulic motor when said speed valve is in said first speed valve position.

5. A device as set forth in claim 4 wherein said first feeder passage is in fluid communication with said second feeder passage, said second feeder passage is in fluid communication with said first engine passage and said second engine passage, said third feeder passage is in fluid communication with said fourth feeder passage, and said fourth feeder passage is in fluid communication with said third engine passage and said fourth engine passage, when said speed valve is positioned in said first speed valve position and said direction valve is in either of said first direction valve position and said second direction valve position for operating the hydraulic motor at the first speed in either one of the first direction of rotation and the second direction of rotation.

6. A device as set forth in claim 3 wherein three of said plurality of engine passages are configured to direct a working fluid to the hydraulic motor and another one of said plurality of engine passages is configured to receive the working fluid from the hydraulic motor when said speed valve is in said second speed valve position.

7. A device as set forth in claim 6 wherein said first feeder passage is in fluid communication with said second feeder passage and said fifth feeder passage, said second feeder passage is in fluid communication with said first engine passage, said fifth feeder passage is in fluid communication with said second engine passage and said third engine passage, said fourth engine passage is in fluid communication with said fourth feeder passage, and said fourth feeder passage is in fluid communication with said third feeder passage, when said speed valve is positioned in said second speed valve position and said direction valve is positioned in said first direction valve position for operating the hydraulic motor at the second speed in the first direction of rotation.

8. A device as set forth in claim 6 wherein said third feeder passage is in fluid communication with said fourth feeder passage and said fifth feeder passage, said fourth feeder passage is in fluid communication with said fourth engine passage, said fifth feeder passage is in fluid communication with said third engine passage and said second engine passage, said first engine passage is in fluid communication with said second feeder passage, and said second feeder passage is in fluid communication with said first feeder passage, when said speed valve is positioned in said second speed valve position and said direction valve is positioned in said second direction valve position for operating the hydraulic motor at the second speed in the second direction of rotation.

9. A device as set forth in claim 1 wherein said direction valve includes a first end and a second end spaced along a direction valve longitudinal axis from said first end, and wherein said device comprises a first direction valve spring disposed within said second void adjacent said first end of said direction valve for biasing said direction valve along said direction valve longitudinal axis and further comprising a second direction valve spring disposed within said second void adjacent said second end of said direction valve for biasing said direction valve against said first direction valve spring along said direction valve longitudinal axis.

10. A device as set forth in claim 9 further comprising at least one direction valve cap coupled to and in sealing engagement with said housing and configured for sealing said second void and securing said direction valve within said second void.

11. A device as set forth in claim 9 wherein said second void includes a first direction valve pressure chamber at least partially defined by said second void and said direction valve and disposed adjacent said first end of said direction valve and a second direction valve pressure chamber at least partially defined by said second void and said direction valve and disposed adjacent said second end of said direction valve, with said first direction valve pressure chamber in fluid communication with said first feeder passage and configured to receive a working fluid therefrom to provide a pressure force against said direction valve along said direction valve longitudinal axis to move said direction valve between said first direction valve position and said second direction valve position, and said second direction valve pressure chamber in fluid communication with said third feeder passage and configured to receive a working fluid therefrom to provide a pressure force against said direction valve along said direction valve longitudinal axis to move said direction valve between said first direction valve position and said second direction valve position.

12. A device as set forth in claim 1 further including a speed valve spring disposed within said first void adjacent said spring end of said speed valve and configured for biasing said speed valve along said longitudinal axis against the pressure force applied by the control fluid in said speed valve pressure chamber.

13. A device as set forth in claim 1 further comprising at least one speed valve cap coupled to and in sealing engagement with said housing and configured for sealing said first void and securing said speed valve within said first void.

14. A hydraulic motor assembly comprising:

a hydraulic motor; and a control device coupled to said hydraulic motor, said control device comprising:

a housing defining a first void, a second void, a first primary port, a second primary port, and a plurality of passages;

a speed valve disposed within said first void and including a spring end and a pressure end spaced from said spring end along a speed valve longitudinal axis, wherein said speed valve is moveable between a first speed valve position and a second speed valve position, with said first speed valve position configured for operating said hydraulic motor at a first speed and said second speed valve position configured for operating said hydraulic motor at a second speed; and a direction valve disposed within said second void and moveable between a first direction valve position and a second direction valve position, with said first direction valve position configured for operating said hydraulic motor in a first direction of rotation and said second direction valve position configured for operating said hydraulic motor in a second direction of rotation opposite said first direction of rotation;

wherein said speed valve is operable to change between said first speed valve position and said second speed valve position when said direction valve is disposed in either said first direction valve position or said second direction valve position;

wherein said plurality of passages further includes a first feeder passage in fluid communication with said first primary port and said second void, a second feeder passage in fluid communication with said second void and said first void, a third feeder passage in fluid communication with said second primary port and said second void, a fourth feeder passage in fluid communication with said second void and said first void, a fifth feeder passage in fluid communication with said second void and said first void, and a plurality of engine passages in fluid communication with said first void and said hydraulic motor;

wherein said plurality of engine passages includes a first engine passage, a second engine passage, a third engine passage and a fourth engine passage;

wherein said first void includes a speed valve pressure chamber at least partially defined by said housing and said speed valve adjacent said pressure end of said speed valve; and wherein said housing defines a speed change port and said plurality of passages includes a speed change passage interconnecting said speed change port and said speed valve pressure chamber of said first void, with said speed change passage configured for directing a control fluid directly into said speed valve pressure chamber of said first void from said speed change port to apply a pressure force to said speed valve along said speed valve longitudinal axis to move said speed valve between said first speed valve position and said second speed valve position.

15. An assembly as set forth in claim 14 wherein two of said plurality of engine passages are configured to direct a working fluid to said hydraulic motor and another two of said plurality of engine passages are configured to receive the working fluid from said hydraulic motor when said speed valve is in said first speed valve position.

16. An assembly as set forth in claim 15 wherein said first feeder passage is in fluid communication with said second feeder passage, said second feeder passage is in fluid communication with said first engine passage and said second engine passage, said third feeder passage is in fluid communication with said fourth feeder passage, and said fourth feeder passage is in fluid communication with said third engine passage and said fourth engine passage, when said speed valve is positioned in said first speed valve position and said direction valve is in either of said first direction valve position and said second direction valve position for operating said hydraulic motor at the first speed in either one of said first direction of rotation and said second direction of rotation.

17. An assembly as set forth in claim 14 wherein three of said plurality of engine passages are configured to direct a working fluid to said hydraulic motor and another one of said plurality of engine passages is configured to receive the working fluid from said hydraulic motor when said speed valve is in said second speed valve position.

18. An assembly as set forth in claim 17 wherein said first feeder passage is in fluid communication with said second feeder passage and said fifth feeder passage, said second feeder passage is in fluid communication with said first engine passage, said fifth feeder passage is in fluid communication with said second engine passage and said third engine passage, said fourth engine passage is in fluid communication with said fourth feeder passage, and said fourth feeder passage is in fluid communication with said third feeder passage, when said speed valve is positioned in said second speed valve position and said direction valve is positioned in said first direction valve position for operating said hydraulic motor at said second speed in said first direction of rotation.

19. An assembly as set forth in claim 17 wherein said third feeder passage is in fluid communication with said fourth feeder passage and said fifth feeder passage, said fourth feeder passage is in fluid communication with said fourth engine passage, said fifth feeder passage is in fluid communication with said third engine passage and said second engine passage, said first engine passage is in fluid communication with said second feeder passage, and said second feeder passage is in fluid communication with said first feeder passage, when said speed valve is positioned in said second speed valve position and said direction valve is positioned in said second direction valve position for operating said hydraulic motor at said second speed in said second direction of rotation.

* * * * *